US007307491B2

(12) United States Patent
Khazanov

(10) Patent No.: US 7,307,491 B2
(45) Date of Patent: Dec. 11, 2007

(54) HIGH DENSITY THREE-DIMENSIONAL RF / MICROWAVE SWITCH ARCHITECTURE

(75) Inventor: Aleksandr Khazanov, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 155 days.

(21) Appl. No.: 11/284,293

(22) Filed: Nov. 21, 2005

(65) Prior Publication Data

US 2007/0115076 A1 May 24, 2007

(51) Int. Cl.
*H01P 1/10* (2006.01)
*H01P 5/12* (2006.01)

(52) U.S. Cl. ..... 333/105; 333/262

(58) Field of Classification Search ..... 333/105, 333/106, 262; 335/4, 5
See application file for complete search history.

(56) References Cited

U.S. PATENT DOCUMENTS

| | | | | |
|---|---|---|---|---|
| 3,260,967 | A * | 7/1966 | Tilman et al. | 333/105 |
| 5,936,482 | A * | 8/1999 | Ando et al. | 333/108 |
| 6,876,056 | B2 | 4/2005 | Tilmans et al. | |
| 2004/0095205 | A1 | 5/2004 | Schaffner et al. | |
| 2004/0155725 | A1 | 8/2004 | Kwaitkowski | |
| 2005/0068129 | A1 | 3/2005 | Denatale et al. | |

* cited by examiner

*Primary Examiner*—Dean Takaoka
(74) *Attorney, Agent, or Firm*—Darby & Darby PC; Robert J. Sacco

(57) ABSTRACT

RF switching system (100, 200) formed from a structure (102, 202) comprised of dielectric material. The structure can have two or more faces (104, 204), with at least one face located in a plane exclusive of at least a second one of the faces. For example, the structure can define a geometric shape that is a polyhedron. RF switches (106, 206) can be disposed on two or more of the faces. Conductive RF feed stubs (110, 210) are provided for each RF switch extending from an interconnection point (114, 214) to electrical contact terminals (116, 216) that are respectively connected to the RF switches. The interconnection point is located within the structure at a location generally medial to the two or more of terminals.

20 Claims, 6 Drawing Sheets

HIGH DENSITY THREE-DIMENSIONAL RF / MICROWAVE SWITCH ARCHITECTURE

STATEMENT REGARDING FEDERALLY SPONSORED RESEARCH OR DEVELOPMENT

This invention was made with government support under Contract No. FA8709-04-C-0010. The government has certain rights in the invention.

BACKGROUND OF THE INVENTION

1. Statement of the Technical Field

The inventive arrangements relate generally to RF switches, and more particularly to high density microwave switch architectures.

2. Description of the Related Art

RF/microwave switches are used in a wide variety of applications. For example, they can be used for switching multiple inputs to multiple outputs, routing of RF signals, selecting a particular input for a device from among multiple input signal sources, and switching a particular device into and out of a circuit. Various techniques are known for implementing RF switching. For example, PIN diodes are often used for this purpose. Developments in Micro-Electro-Mechanical Systems (MEMS) also include RF switching devices that demonstrate useful performance at microwave frequencies. A number of different switch topologies are available for MEMS RF switches. In general, these devices offer lower insertion loss, consume less power, and offer higher linearity as compared to other similar sized devices. Still, existing single pole multiple throw switches for RF and microwave applications of any dimension are often limited with regard to the number of throws that can be provided without adversely affecting switch performance. Increasing the number of paths often tends to degrade the switch performance and increase switch size. These are important design considerations since RF performance and switch density are two critical requirements for many military, industrial, and commercial applications.

One performance limiting factor for single-pole multiple-throw (SPMT) and multiple-pole multiple-throw (MPMT) type RF switches arises from relatively long stub lengths as compared to wavelength of interest. Long stub lengths required for communicating RF to and from MEMS switches tends to be largely unavoidable in current architectures due to the generally planar layout of such devices. Close spacing of MEMS switches in particular also can be a problem because of the difficulty associated with shielding actuation mechanisms. For example, actuation of one magnetically actuated switch can inadvertently result in activation of an adjacent switch.

As a result of these and other difficulties, the largest value of N for a single pole N throw switch manufactured from conventional mechanical relays is presently about 14. Architectures for MEMS type SPMT and MPMT switches have generally included flat and layered architectures. Layered architectures generally are designed around 2-dimensional stripline layouts with coaxial layer interconnects. However, even these layered MEMS designs have not managed to increase the number of throws beyond about 14 without significant performance degradation, size and cost penalties.

SUMMARY OF THE INVENTION

The invention concerns an RF switching system. The system is formed from a structure comprised of dielectric material. The structure can have two or more faces, with at least one face located in a plane exclusive of at least a second one of the faces. For example, the structure can define a geometric shape that is a polyhedron. Further, at least a first one of the faces can have an orientation that is generally orthogonal relative to at least a second one of the faces. According to another aspect of the invention, the polyhedron can be an orthogonal polyhedron.

RF switches can be disposed on or adjacent to two or more of the faces. The RF switches can be positioned directly on the surface of the face. Alternatively, the RF switches can be respectively positioned at least partially above or at least partially below the surface defined by each face. For example, the RF switches can be embedded entirely below the surface of the face.

According to one aspect of the invention, the RF switches can be MEMS devices. Conductive RF feed stubs are provided for each RF switch. The feed stubs can extend from an interconnection point to electrical contact terminals that are respectively connected to the RF switches. According to one aspect of the invention, the interconnection point can be located within the structure at a location medial to the two or more of terminals. Further, the RF switches on or adjacent to the respective faces can be positioned with an orientation that generally provides a minimal distance between the interconnection point and each of the RF switch terminals. At least one transmission line can be disposed on a surface of the structure for communicating RF energy to and from at least one of the RF switches. At least one control circuit can also be disposed on a portion of the structure for controlling an operation of at least one of the RF switches. The control circuit can include one or more signal traces, signal conditioning circuitry and/or any necessary driver circuitry. Further, an RF port can be connected to the interconnection point for feeding RF energy to and from the RF switches.

At least one of the RF switch systems as described herein can be disposed in or on at least one board formed of dielectric material. Further, the switch system can be positioned on the dielectric board with the RF port positioned adjacent to an edge of the dielectric board. Mounting the RF switch system to the board with the RF port positioned in this way can facilitate assembly of the RF switch systems into an array. For example, two or more such boards can be stacked and interconnected with one another.

DETAILED DESCRIPTION OF THE PREFERRED EMBODIMENTS

Figure 1:
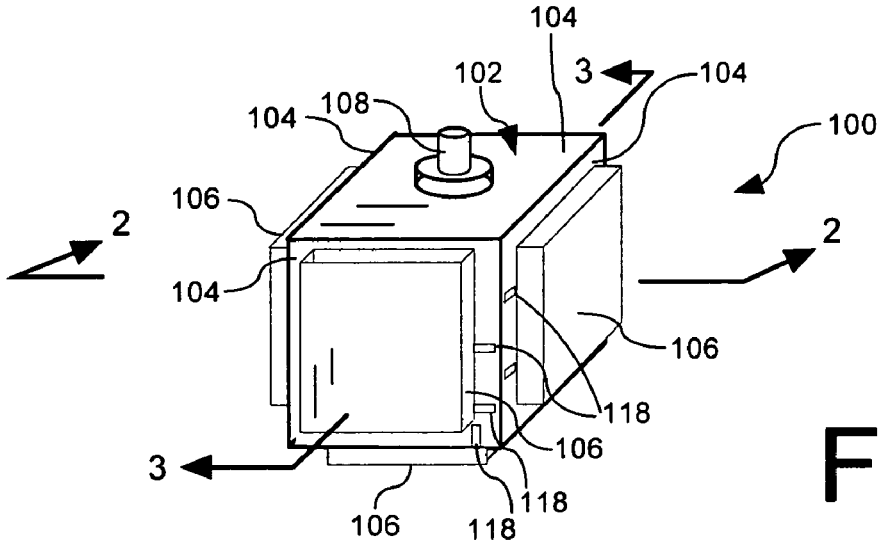
FIG. 1 is perspective view of an RF switching system that is useful for understanding the invention.

FIG. 1 shows an embodiment of an RF switching system 100. The RF switching system 100 can be formed from a structure 102 comprised of dielectric material. In general, the structure can have two or more faces 104, with at least one face located in a plane exclusive of a remainder of the faces. In FIG. 1, the structure 102 is shown as a cube. However, the invention is not limited in this regard. For example, the structure 102 can have any 3-dimensional geometric polyhedron form. As used herein, the term polyhedron refers to any three dimensional object that is bounded by a plurality of polygon shapes. According to one embodiment, at least a first one of the faces 104 can have an orientation that is generally orthogonal relative to at least a second one of the faces 104. According to another aspect of the invention, the polyhedron can be an orthogonal polyhedron. An orthogonal polyhedron is a polyhedron each of whose faces is perpendicular to a coordinate axis. The cube shown in FIG. 1 is a polyhedron bounded by six polygon faces (in this case squares) meeting at right angles. The point at which three or more faces intersect on a polyhedron is called a vertex, and a line along which two faces intersect is called an edge.

The structure 102 can be formed by any suitable means. For example, the structure can be micro-machined from a solid block of dielectric material. The interior of the structure can be substantially hollow or can be at least partially filled with the same or a different type of dielectric material. Structure 102 and each of the faces 104 can be formed of a dielectric material. For example, the dielectric material can be a conventional glass microfiber reinforced PTFE composite laminate. Such laminates are well known in the art. For example, suitable materials can include RT/duroid® 5870 and/or RT/duroid® 5880, both of which are commercially available from Rogers Corporation of Rogers, Conn. Alternatively, the dielectric material forming the structure 102 can be any of a variety of low temperature cofired ceramic (LTCC) products. Examples of suitable LTCC materials can include DuPont™ 951 Green Tape™ System and DuPont™ 943 Low Loss Green Tape™ System, both of which are available from DuPont Corporation.

A variety of other materials and processes can also be used to form the dielectric structure 102. For example, sequential layer construction techniques can be used that are similar to those used when building layered circuit boards. Injection molding processes and micromachining techniques can also be used. Each of the foregoing processes can be applied to either single-piece or multi-piece assembly structures.

RF switches 106 can be disposed on two or more of the faces 104. A plurality of vias can be formed on the structure 102 for receiving therein a plurality of terminals 116 extending from one or more RF switches 106. According to one aspect of the invention, the RF switches 106 can be Micro-Electro-Mechanical Systems (MEMS) devices. A variety of MEMS type RF switches are well known in the art. The two common circuit configurations are single pole single throw (SPST) and single pole double throw (SPDT). The most common mechanical structures for such devices are the cantilever arm and the air bridge arrangements, each of which are well known in the art. Most of these systems rely upon magnetic or electrostatic actuation mechanisms. The RF connections that are formed using such switches are typically either capacitive (metal-insulator-metal) or ohmic (metal-to-metal).

Examples of suitable RF switches that can be used for implementing the RF switch system of the present invention can include Model No. M1C06-CDK2, which is available from Dow-Key Microwave Corporation of Ventura Calif. The M1C06-CDK2 RF MEMS switch is an ultraminiature, quasi-hermetic, latching SPDT relay with exceptional broadband RF performance and reliability. Bipolar voltage pulses (+5V;−5V) are used to control the switch. The dimensions of the switch are approximately 6 mm×6 mm×3 mm. Another RF switch that can be used for the present invention includes Model No. RMSW 220D, which is available from Radiant MEMS, Inc. of Stow, Mass. The RMSW 220D is a SPDT reflective RF switch that provides high-linearity, high isolation, and low-insertion loss in chip and chip-scale package configurations. Of course, any other suitable RF switch can be used, and the invention is not intended to be limited to these particular examples.

RF energy can be communicated to and from the RF switching system 100 by means of an RF port 108. The RF port 108 can be any suitable connection point that facilitates transfer of RF energy to and from the switch. For example, the RF port 108 can be provided in the form of a subminiature RF connector. One example of such a connector is the SMP style of subminiature interface connectors that are commercially available from Amphenol Corporation of Wallingford, Conn. The SMP series of connectors offers a frequency range of DC to 40 GHz and is commonly used in miniaturized high frequency coaxial modules. Still, those skilled in the art will appreciate that the invention is not limited in this regard. For example, the RF port 108 can also be implemented as any arrangement of conductive contacts and dielectric structures that are suitable for permitting RF energy to be delivered to and from the RF switching system 100.

Figure 2:
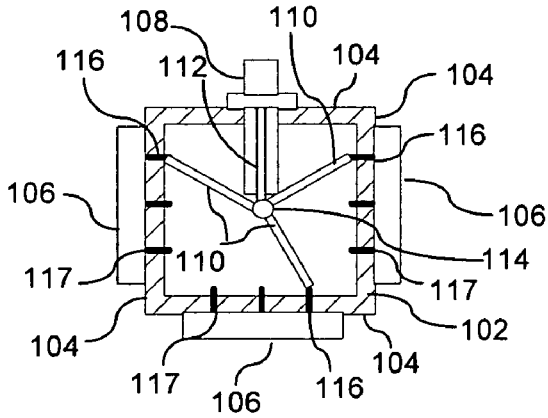
FIG. 2 is a cross-sectional view of the RF switching system in FIG. 1 taken along line 2-2 in FIG. 1
Figure 3:
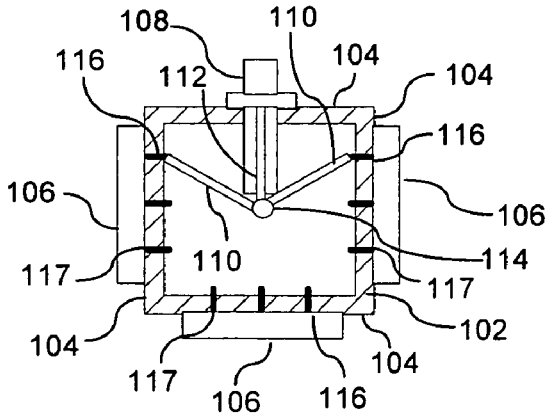
FIG. 3 is a cross-sectional view of the RF switching system in FIG. 1 taken along line 3-3 in FIG. 1

Referring now to FIGS. 2 and 3, it can be observed that RF energy at RF port 108 can be communicated to and from the RF switches 106. It will be appreciated by those skilled in the art that the electrical distance between the RF port 108 and an interconnection point 114 can be somewhat shorter or longer depending on the particular polyhedron shape selected for the structure 102. For very relatively short distances such as shown in FIGS. 1-3, a conductive line 112 can be a simple conductive stub that is used to connect RF energy from the RF port 108 to the interconnection point 114. Relatively short distances as referred to herein would generally tend to include those that are less than about 0.1 wavelengths at the operating frequency of the device. Alternatively, conductive line 112 can be an RF transmission line connected to the RF port 108 and the interconnection point 114. Those skilled in the art will appreciate that any suitable type of RF transmission line can be used for this purpose. According to one embodiment, a coaxial cable can be used. For example the coaxial cable can be a hard line type of coaxial cable with a solid outer metal shield. According to another embodiment, the conductive line 112 can be arranged as a microstrip or stripline type of transmission line. Still, those skilled in the art will appreciate that the invention is not limited with regard to any particular arrangement for transporting RF to the interconnection point.

As shown in FIGS. 2 and 3, each RF switch can have a plurality of terminals 116 for communicating RF energy to and from the RF switches 106. A second plurality of terminals 117 can be connected to a different pole or contact of each RF switch 106. For example, terminals 117 can be a switched output terminal. A low loss path can be alternately provided or not provided between terminals 116 and 117 depending upon the configuration of the switch. The exact number of terminals on each switch can vary depending on the switch configuration. In any case, at least one terminal 116 on each RF switch 106 can be operatively connected to the interconnection point 114. The interconnection point 114 is advantageously located within the structure 102. Selecting the position of the interconnection point 114 to be within the structure 102 can generally minimize the maximum distance between the interconnection point 114 and any of the terminals 116 to which the interconnection point is connected. For example, the interconnection point can be selected to be at a location that is generally medial to the terminals which the interconnection point is connected to.

As used herein, the term "medial" generally refers to a location within the structure 102 that is situated at or near the midline or center of the body or a body structure. It will be appreciated that the precise location of the interconnection point 114 does not need to be the exact center of the structure. Instead, the location can vary somewhat depending on a variety of factors, such as the configuration of the polyhedron, the particular faces 102 of the polyhedron on which RF switches 106 are disposed, and the arrangement of terminals 116 on the RF switches. In general, however, the interconnection point 114 should be selected to maintain a relatively small distance between each of the RF switch terminals 116 and the interconnection point 114.

Similarly, the RF switches 106 that are disposed on the respective faces 104 can be positioned with an orientation that generally provides a minimum distance between the interconnection point 114 and each of the RF switch terminals 116. The exact orientation of each RF switch 106 will of course depend on the particular configuration of the polyhedron, the size and shape of the faces, the size and shape of the RF switches 106, and the arrangement of the terminals on each RF switch. Depending upon the particular polyhedron configuration that is used, it can be advantageous to avoid situating an RF switch on certain faces in order to avoid excessively large distances between the terminal 116 and the interconnection point.

A plurality of conductive feed stubs 110 can be used for communicating RF energy from the interconnection point 114 to the appropriate terminal 116 of the RF switches 106. As shown in FIGS. 2 and 3, these feed stubs can be arranged in a radial configuration, extending outwardly from the central interconnection point 114. The feed stubs can be formed by any suitable means. According to one aspect of the invention, however, a micro-machining process can be used to form the interconnection point and the feed stubs as a single integrated unit. The stubs construction technique can be implemented by any suitable means. For example, the stubs can be formed as plated vias, copper traces, striplines, wires or coaxial feeds. These conductive stubs can be attached to the terminals via traces, soldering, wire bonding, threading and other methods that ensure low impedance reliable connections.

One or more conductive lines 118 can be disposed on an exterior surface of the structure 100. Conductive lines 118 can be used for communicating RF energy to and from an output terminal 117 of the RF switch. The conductive lines 118 can also include one or more signal traces that are associated with driver circuitry for one or more of the RF switches 106. At least one control circuit (not shown) can also be disposed on a portion of the structure for controlling an operation of at least one of the RF switches.

In FIGS. 1-3, one RF switch 106 is shown disposed on each of the faces 104. However, it should be understood that the invention is not limited in this regard. For example, a designer can choose not to include an RF switch on one or more faces 104 of the polyhedron structure 102. Certain designs may require a lesser number of switches. Moreover, certain polyhedron structures can have faces that are too distant from a central interconnection point to be useful for placement of RF switches. Accordingly, a designer can choose not to include an RF switch on one or more such faces of the structure. Moreover, the invention is not necessarily limited to the inclusion of only a single RF switch 106 on each face 104. Instead, two or more RF switches can be disposed on each face, subject to the space limitations on the face, and the form factor of the RF switches and terminals. In addition, switches and other components can be disposed on the surface of the dielectric structure, recessed within the dielectric structure or embedded within the dielectric structure. Examples of these other components can include switch drivers, resistive terminations, and RF signal conditioning components.

Figure 4:
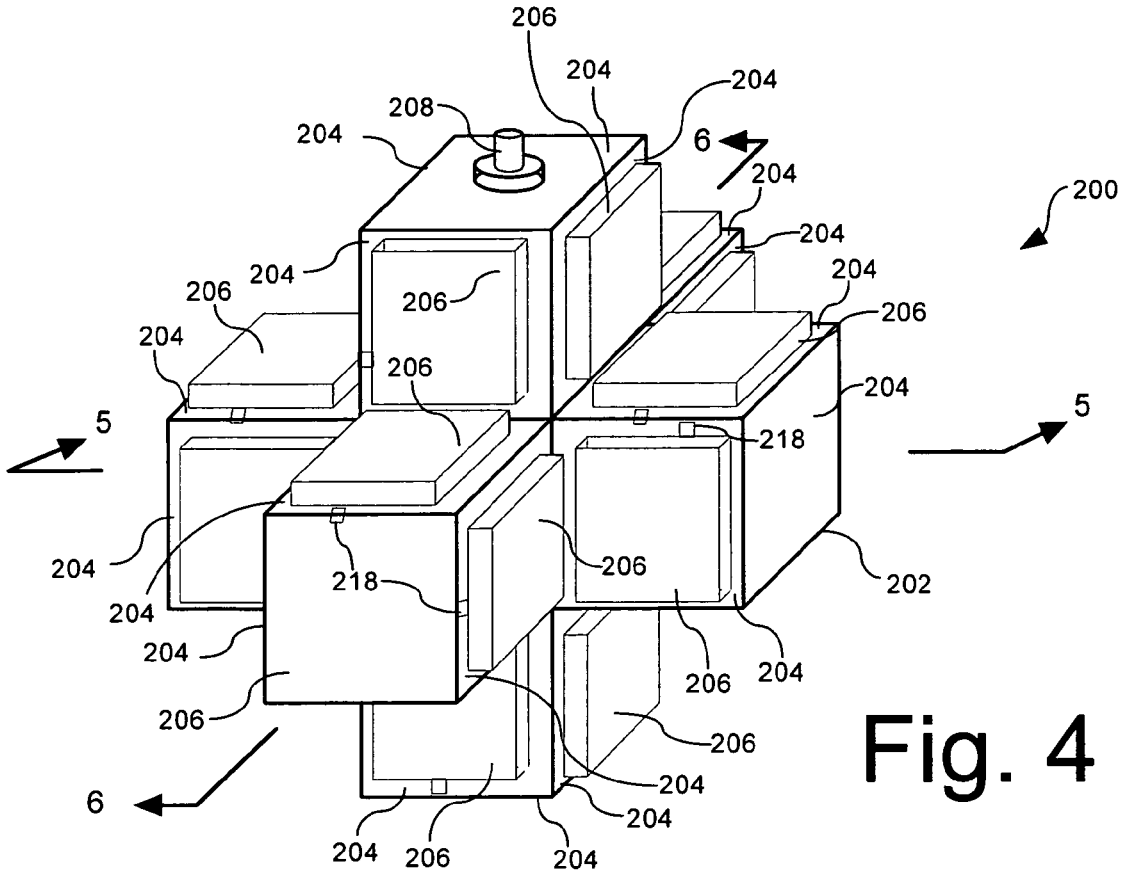
FIG. 4 is perspective view of a second embodiment of an RF switching system that is useful for understanding the invention.
Figure 5:
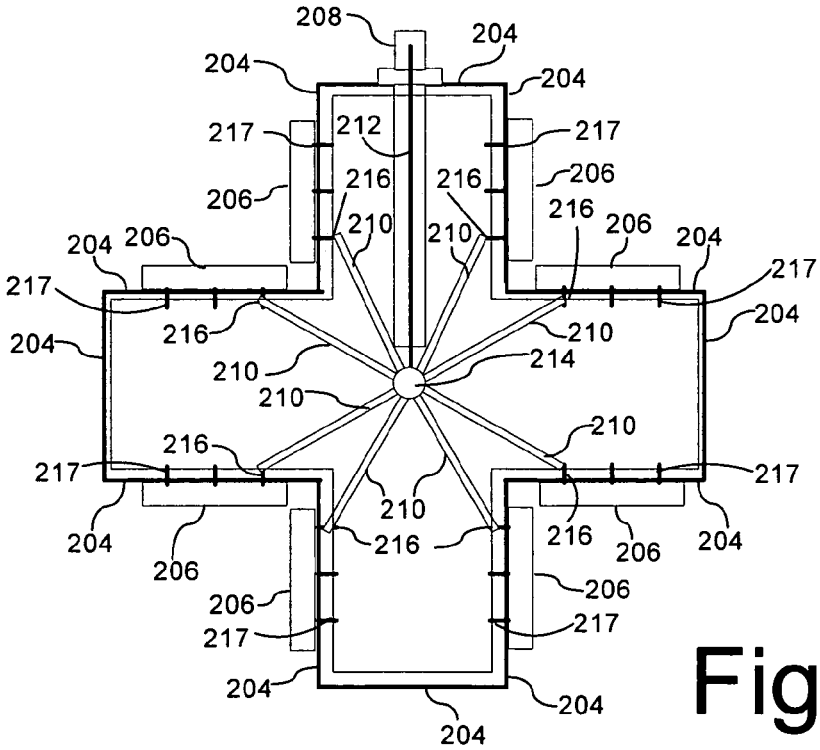
FIG. 5 is a cross-sectional view of the RF switching system in FIG. 1 taken along line 5-5 in FIG. 4
Figure 6:
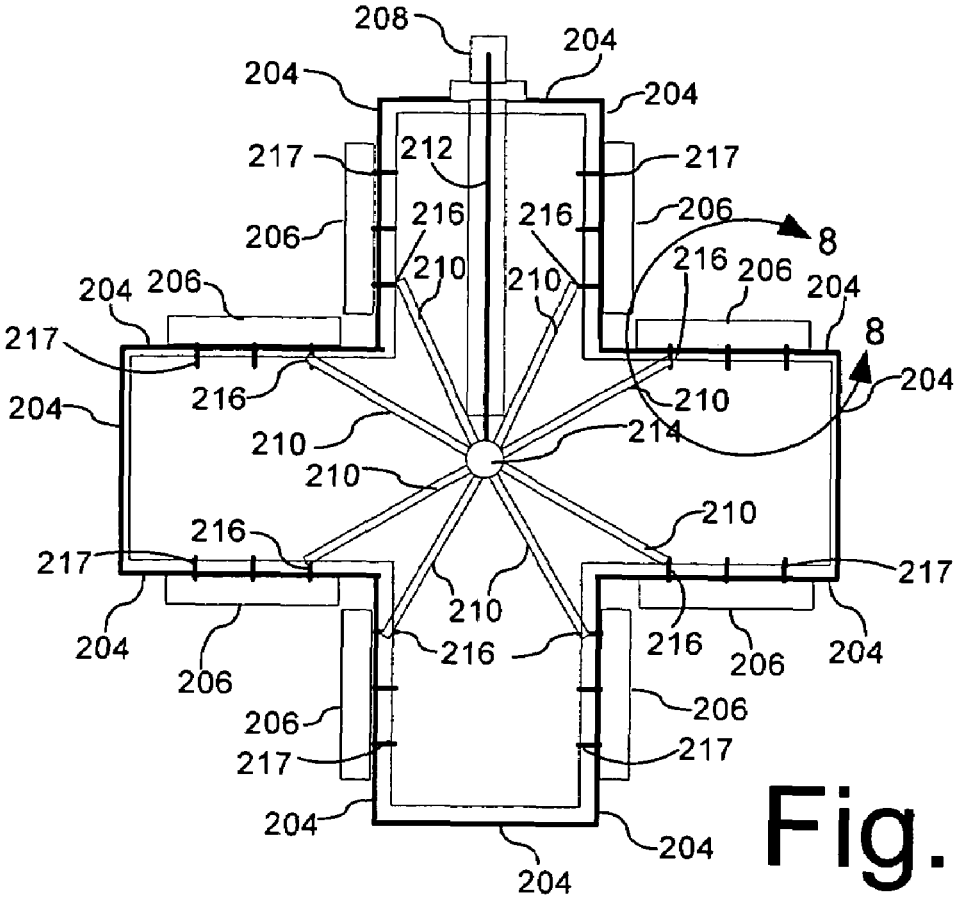
FIG. 6 is a cross-sectional view of the RF switching system in FIG. 1 taken along line 6-6 in FIG. 4

Referring now to FIGS. 4-7, there is shown a second embodiment of an RF switching system 200 according to the present invention. The RF switching system 200 is similar to the RF switching system 100 except that in this case the dielectric structure 202 is a polyhedron formed in the shape of a three-dimensional cross rather than a cube. Like the cube in FIGS. 1-3, the three-dimensional cross in FIGS. 4-6 is an example of an orthogonal polyhedron. The RF switching system 200 includes a plurality of RF switches 206 disposed on polyhedron faces 204. An RF port 208 communicates RF energy through a conductive line 212 to an interconnection point 214. As with the cube configuration, the conductive line can be either stub or a transmission line. However, it may be observed that the polyhedron structure in FIGS. 4-6 results in the RF port 208 being positioned a relatively large distance from the interconnection point 214. Accordingly, it can be advantageous with this particular structure to form the conductive line 212 as an RF transmission line. For example, a coaxial cable, microstrip or stripline type transmission line can be used for this purpose.

Interconnection point 214 feeds a plurality of terminals 216 connected to RF switches 206. The interconnection point 214 is positioned within the structure 202 at a location generally medial to the terminals 216 of the RF switches 206 to which the interconnection point 214 is intended to connect with. As shown in FIGS. 5 and 6, a plurality of conductive feed stubs 210 can extend from the interconnection point 214. If the distance between the interconnection point 214 and the terminals 216 is substantially smaller as compared to the operating frequency wavelength of the device, then the feed stubs 210 need not be formed as RF transmission lines, but can instead be maintained as simple conductive stubs. The feed stubs 210 are electrically connected on opposing ends to the interconnection point 214 and the respective terminals 206. A second set of terminals 217 provided on each RF switch can serve as a switched output terminal of the RF switch 206. A low loss path can be alternately provided or not provided between terminals 216 and 217 depending upon the configuration of the switch.

The RF switching system 200 is generally similar to the RF switching system 100 and can be constructed using similar techniques and materials. However, it may be noted that in RF switching system 200, the faces 204 of the structure 202 that are most distant from the interconnection point are not used. Thus, it will be appreciated that RF switches need not be provided on all faces. In FIGS. 4-6, a designer can choose not to position RF switches 206 at the faces 204 that are most distant from the interconnection point 214. As noted above, the need to maintain very short feed stubs can make it undesirable to position RF switches on certain faces when using certain types of polyhedrons.

Figure 7:
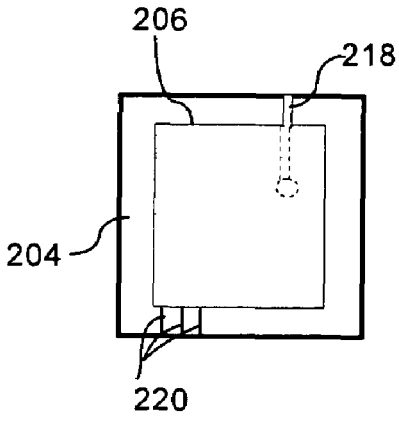
FIG. 7 is a top view of a single face of the RF switching system in FIG. 4.
Figure 8:
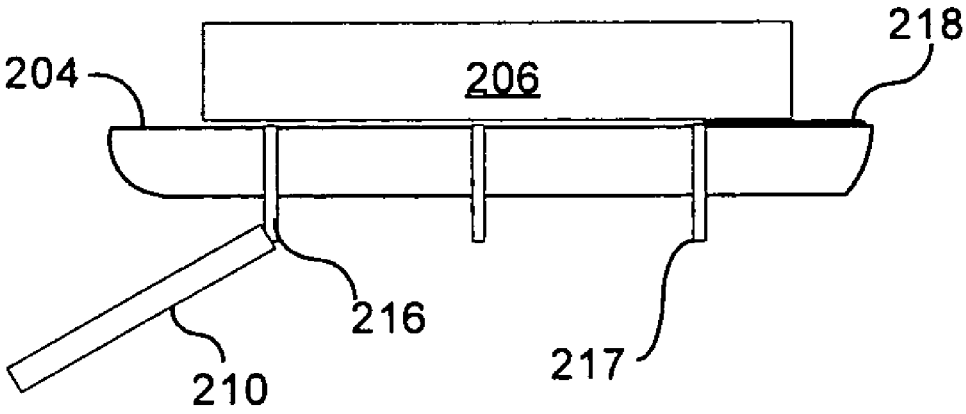
FIG. 8 is an enlarged cross-sectional view of an RF switch mounted on a face of the RF switching system in FIG. 4.

Referring now to FIGS. 4, 7 and 8, it can be observed that one or more conductive lines 218 can be disposed on an exterior surface of the structure 200. Conductive lines 218 can be used for communicating RF energy to and from a terminal 217 of the RF switches. The conductive lines 218 can also include one or more signal traces that are associated with driver circuitry for one or more of the RF switches 206. At least one control circuit (not shown) can also be disposed on a portion of the structure for controlling an operation of at least one of the RF switches 206.

Regardless of the particular polyhedron shape that is selected for dielectric structures 102, 202, it can be advantageous to provide some means to communicate RF energy from the RF switch to some additional circuitry. For example, the RF switching system can be connected to other similar RF switching system to define a matrix of such switching systems. Alternatively, it can be desirable to directly connect the input or output of the RF switching system to an antenna system, test equipment, transceiver equipment, or any other type of RF equipment requiring switching services. The polyhedron configuration of the switching system can make assembly of such a switching matrix difficult because of the unusual form factor associated with the polyhedron. Accordingly, in order to facilitate the construction of such a switching matrix, it can be desirable to integrate the switching system into a conventional circuit board configuration.

Figure 9:
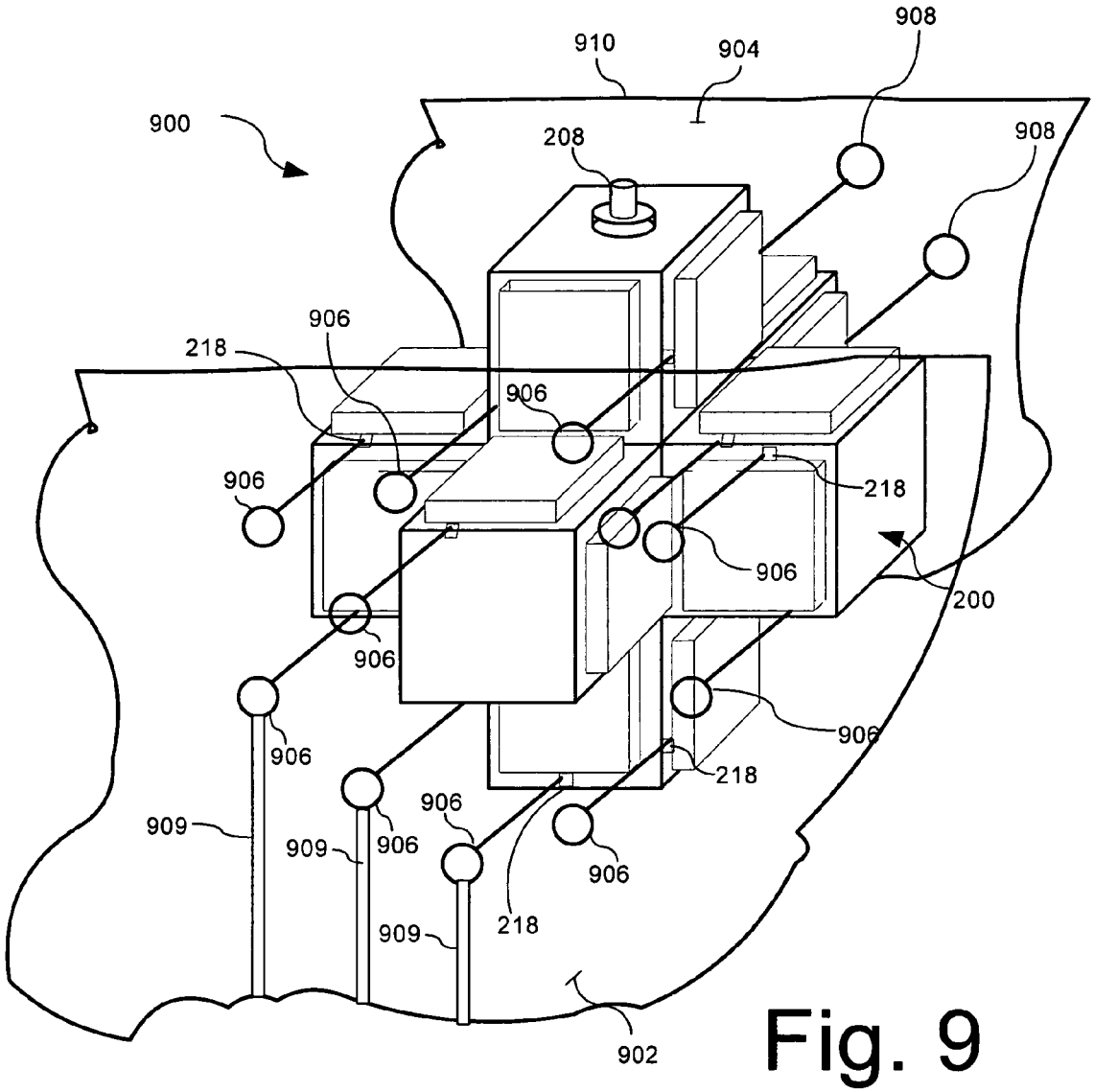
FIG. 9 is a partial cut-away perspective view showing the RF switching system in FIG. 4 mounted between two opposing dielectric board surfaces.

Referring now to FIG. 9, it can be observed that at least a portion of a switching system as described herein can be positioned within two opposing surfaces 902, 904 to form a switch assembly 900. Each of the surfaces 902, 904 can be formed of a dielectric material. For example, the dielectric material can be formed from sheets of conventional glass microfiber reinforced PTFE composite laminates. Such laminates are well known in the art and are especially designed for stripline and microstrip circuit applications. Examples of such materials can include RT/duroid® 5870 and RT/duroid® 5880, which are commercially available from Rogers Corporation of Rogers, Conn. Alternatively, the dielectric material can be any of a variety of low temperature cofired ceramic (LTCC) products. Examples of suitable LTCC materials can include DuPont™ 951 Green Tape™ System and DuPont™ 943 Low Loss Green Tape™ System, both of which are available from DuPont Corporation.

In FIG. 9, switching system 200 is shown disposed entirely between surfaces 902, 904. However, it will be understood that the switching system need not be entirely disposed within the surfaces 902, 904. Instead, a portion of the switching system 200 can extend through the surfaces 902, 904. According to one embodiment, the surfaces 902, 904 can form opposing sides of a single board or sheet and the switching system 200 can be at least partially embedded within the dielectric board. According to a second embodiment, the dielectric surfaces 902, 904 can be opposing surfaces on two separate dielectric boards. In that case, at least a portion of the switching system 200 can be positioned within an interior space defined by the two opposing surfaces 902, 904. The same surfaces can also form a part of the polyhedron structure.

Referring again to FIG. 9, a single switching system 200 is shown for convenience. However, it should be understood that two or more switching systems can be disposed between the surfaces 902, 904. For example, a plurality of switching systems 200 can be provided between surfaces 902, 904 and the various switching systems can be operatively connected to each other. More particularly, a plurality of RF stubs 906 can be provided for communicating RF energy from the conductive lines 218 to conductive traces 909 disposed on or below the surfaces 902, 904. The conductive stubs 906 can be bonded to the conductive lines 218 using conventional solder, wire bonding, or any other suitable interconnection techniques. Alternatively, if the RF switching system 200 is embedded within the substrate, the RF stubs 906 can be conductive vias formed in the dielectric material between the conductive lines 218 and the conductive traces 909.

According to one embodiment, one or more of the conductive traces 909 can be RF transmission lines. The RF transmission lines can be used to transport RF energy from one RF switch system 200 to similar RF switching systems 200 that are also positioned between the surfaces 902, 904. Additional conductive traces 909 can be provided for switching control circuitry for the various RF switching systems 200.

It will further be appreciated that switching systems similar to switching system 200, but formed from other polyhedron shapes can also be incorporated between or partially between the surfaces 902, 904 as herein described. In this regard, the switching system 200 in FIG. 9 is merely as one possible example.

RF ports 208 can be aligned along one or more edges 910 of surfaces 902, 904. Such positioning can facilitate interconnection of the RF ports 208 to other switch assemblies 900 or other RF circuitry in a manner which shall be hereinafter described. The RF ports 208 can provide a convenient means for communicating RF energy onto the switch assemblies and ultimately to the RF switches 206. Mounting the RF switch system to the board with the RF ports disposed thereon can also facilitate assembly of the RF switch systems into an array. For example, two or more such boards can be stacked and interconnected with one another to define a switching matrix.

Figure 10:
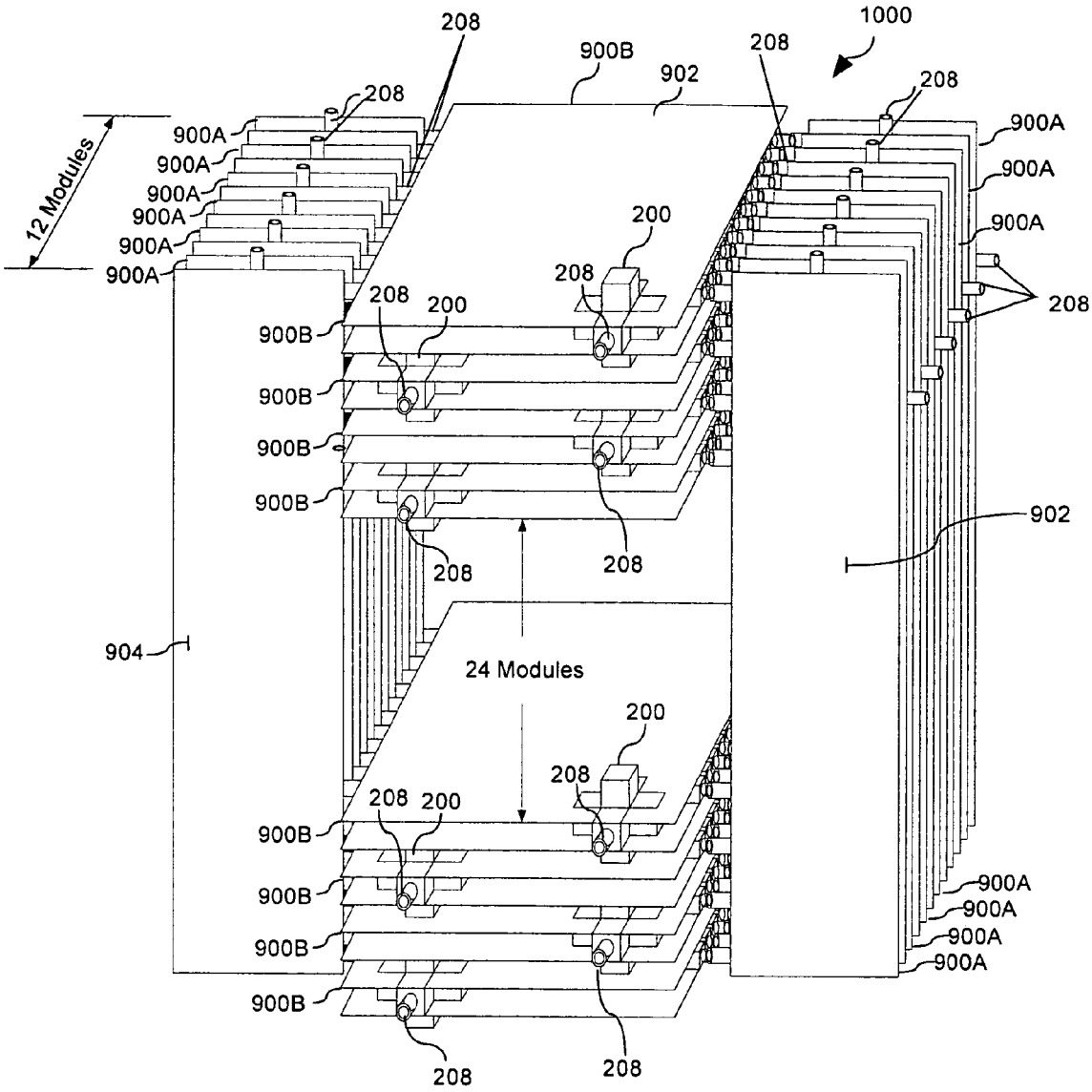
FIG. 10 is a perspective view of a switch matrix incorporating the RF switching system in FIG. 9.

Referring now to FIG. 10, there is illustrated a switch matrix 1000 that is comprised of 24 switch assemblies 900A that are oriented vertically on opposing sides of a stack of 24 switch assemblies 900B that are oriented horizontally. Switch assemblies 900A and 900B can be generally constructed as described above with respect to switch assembly 900. Depending upon the particular arrangement of the switch matrix 1000, the switch assemblies 900A and 900B can be the same or can vary somewhat in their exact layout depending on their relative position within the matrix 1000. The RF ports 208 can be used to interconnect the various switch assemblies 900A, 900B. The RF ports 208 can also be used for communicating RF to and from the switch matrix 1000. As previously noted RF switch systems 200 can be completely or partially contained below the surfaces 902, 904. In FIG. 10, both arrangements are shown, with some switching systems 200 entirely disposed between surfaces 902, 904 while others are shown extending partially through surfaces 902, 904. Either arrangement can be used.

The invention described and claimed herein is not to be limited in scope by the preferred embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

I claim:

1. An RF switching system, comprising:

a structure formed of a dielectric material and having a plurality of faces, at least one said face located in a plane exclusive of a second one of said faces;

a plurality of RF switches respectively disposed on or adjacent to said plurality of faces;

a plurality of conductive RF feed stubs extending from an interconnection point of said RF feed stubs to a plurality of terminals respectively connected to said RF switches; and wherein said structure defines a geometric shape that is a polyhedron.

2. An RF switching system, comprising:

a structure formed of a dielectric material and having a plurality of faces, at least one said face located in a plane exclusive of a second one of said faces;

a plurality of RF switches respectively disposed on or adjacent to said plurality of faces;

a plurality of conductive RF feed stubs extending from an interconnection point of said RF feed stubs to a plurality of terminals respectively connected to said RF switches; and wherein said plurality of RF switches are respectively positioned at a location and with an orientation that provides a distance between said interconnection point and each said terminal that is less than 0.25 wavelengths at the highest frequency at which the RF switching system is designed to operate.

3. The RF switching system according to claim 2, wherein said geometric shape is an orthogonal polyhedron.

4. An RF switching system, comprising:

a structure formed of a dielectric material and having a plurality of faces, at least one said face located in a plane exclusive of a second one of said faces;

a plurality of RF switches respectively disposed on said plurality of faces; and a plurality of conductive RF feed stubs extending from an interconnection point of said RF feed stubs to a plurality of terminals respectively connected to said RF switches.

5. The RF switching system according to claim 4, wherein said interconnection point is located within said structure at a location medial to said plurality of terminals.

6. The RF switching system according to claim 4, wherein at least a first one of said plurality of faces has an orientation that is orthogonal relative to at least a second one of said plurality of faces.

7. The RF switching system according to claim 4, further comprising an RF port attached to said structure for communicating RF energy to or from said interconnection point.

8. The RF switching system according to claim 4, wherein said structure is mounted to a dielectric circuit board.

9. The RF switching system according to claim 8, further comprising an RF port attached to said structure for communicating RF energy to or from said interconnection point, wherein said RF port is positioned adjacent to an edge of said dielectric circuit board.

10. The RF switching system according to claim 4, further comprising at least one circuit disposed on or adjacent a surface of said structure, said at least one circuit selected from the group consisting of a control circuit for controlling an operation of said RF switch and an RF signal conditioning circuit for modifying or improving an RF performance of said RF switch.

11. The RF switching system according to claim 4, wherein said plurality of RF switches are positioned at least partially above or at least partially below respective ones of said plurality of faces.

12. An RF switching system, comprising:

a structure formed of a dielectric material and having a plurality of faces, at least one said face located in a plane exclusive of at least a second one of said faces;

at least one RF switch disposed on or adjacent to a respective one of each of said plurality of faces;

a plurality of conductive RF feed stubs extending from an interconnection point of said RF feed stubs to a plurality of terminals respectively connected to said RF switches, said interconnection point is located within said structure at a location medial to said plurality of terminals; and wherein said plurality of RF switches are respectively positioned at a location and with an orientation that provides a distance between said interconnection point and each said terminal that is less than 0.25 wavelengths at the highest frequency at which the RF switching system is designed to operate.

13. An RF switching system, comprising:

a structure formed of a dielectric material and having a plurality of faces, at least one said face located in a plane exclusive of at least a second one of said faces;

at least one RF switch disposed on or adjacent to a respective one of each of said plurality of faces;

a plurality of conductive RF feed stubs extending from an interconnection point of said RF feed stubs to a plurality of terminals respectively connected to said plurality of RF switches, said interconnection point is located within said structure at a location medial to said plurality of terminals; and wherein said structure defines a geometric shape that is a polyhedron.

14. The RF switching system according to claim 13, wherein said geometric shape is an orthogonal polyhedron.

15. An RF switching system, comprising:

a structure formed of a dielectric material and having a plurality of faces, at least one said face located in a plane exclusive of at least a second one of said faces;

at least one RF switch disposed on a respective one of each of said plurality of faces;

a plurality of conductive RF feed stubs extending from an interconnection point of said RF feed stubs to a plurality of terminals respectively connected to said RF switches, wherein said interconnection point is located within said structure at a location medial to said plurality of terminals.

16. The RF switching system according to claim 15, further comprising an RF port operatively connected to said interconnection point.

17. The RF switching system according to claim 15, further comprising at least one dielectric board, wherein said structure is attached to said dielectric board, and said RF ports is positioned adjacent to an edge of said dielectric board.

18. The RF switching system according to claim 15, further comprising at least one RF transmission line disposed on a surface of said structure for communicating RF energy.

19. The RF switching system according to claim 15, wherein said at least one RF switch is positioned at least partially above or at least partially below said face.

20. An RF switching system, comprising:

a support structure formed of a dielectric material and having a polyhedron shape with a plurality of exterior faces;

at least one RF switch disposed on each respective one of said plurality of exterior faces so as to be structurally supported by said support structure; and a plurality of conductive RF feed stubs extending from an interconnection point of said RF feed stubs to a plurality of terminals respectively connected to said RF switches.

* * * * *